US008554354B1

(12) United States Patent
Pagilla et al.

(10) Patent No.: US 8,554,354 B1
(45) Date of Patent: Oct. 8, 2013

(54) METHOD FOR ADAPTIVE GUIDING OF WEBS

(75) Inventors: Prabhakar Pagilla, Stillwater, OK (US); Aravind Seshadri, Stillwater, OK (US); MD M. Haque, Edmond, OK (US); Ken Hopcus, Edmond, OK (US)

(73) Assignee: The Board of Regents For Oklahoma State University, Stillwater, OK (US)

( * ) Notice: Subject to any disclaimer, the term of this patent is extended or adjusted under 35 U.S.C. 154(b) by 420 days.

(21) Appl. No.: 13/026,089

(22) Filed: Feb. 11, 2011

Related U.S. Application Data

(60) Provisional application No. 61/303,878, filed on Feb. 12, 2010.

(51) Int. Cl.
*G06F 19/00* (2011.01)
*B23Q 15/00* (2006.01)
*B23Q 16/00* (2006.01)

(52) U.S. Cl.
USPC ..... 700/124; 226/15; 226/24

(58) Field of Classification Search
USPC ..... 700/124; 226/15, 24
See application file for complete search history.

(56) References Cited

U.S. PATENT DOCUMENTS

| | | | | | |
|---|---|---|---|---|---|
| 3,610,546 | A | * | 10/1971 | McGorry | 242/563.1 |
| 3,724,732 | A | * | 4/1973 | Bonner | 226/21 |
| 4,269,140 | A | | 5/1981 | Burns et al. | |
| 4,350,276 | A | * | 9/1982 | Kreder et al. | 226/16 |
| 4,477,006 | A | | 10/1984 | Sharp | |
| 4,488,687 | A | * | 12/1984 | Andreasson | 242/527.3 |
| 4,507,073 | A | | 3/1985 | Shelton | |
| 4,574,194 | A | | 3/1986 | Coats et al. | |
| 5,685,955 | A | * | 11/1997 | Leigraf et al. | 162/198 |
| 5,767,686 | A | | 6/1998 | Kespohl | |
| 5,769,298 | A | * | 6/1998 | Plumb | 226/19 |
| 6,289,729 | B1 | | 9/2001 | Haque et al. | |
| 6,323,948 | B2 | | 11/2001 | Haque et al. | |
| 6,635,895 | B2 | | 10/2003 | Haque et al. | |
| 6,985,789 | B2 | * | 1/2006 | Carlson et al. | 700/122 |
| 7,055,726 | B2 | * | 6/2006 | Satoh et al. | 226/20 |
| 7,296,717 | B2 | * | 11/2007 | Swanson et al. | 226/3 |
| 7,415,881 | B2 | | 8/2008 | Haque et al. | |
| 2002/0177918 | A1 | * | 11/2002 | Pierel et al. | 700/124 |
| 2003/0183356 | A1 | * | 10/2003 | Satoh et al. | 162/263 |
| 2010/0038468 | A1 | * | 2/2010 | Hein | 242/419.8 |

OTHER PUBLICATIONS

Vandoren, V. , "Adaptive Controllers: Commercially available controllers can adapt to conditions they haven't experienced previously, gaining knowledge on the fly to make your process behave better", "Control Engineering", 2002, pp. 22-30, Publisher: www.controleng.com.

"Adaptive Control." (n.d.) In Wikipedia, Retrieved Mar. 4, 2009, from http://en.widipedia.org/wiki/Adaptive_control.

* cited by examiner

*Primary Examiner* — Mohammad Ali
*Assistant Examiner* — Sivalingam Sivanesan
(74) *Attorney, Agent, or Firm* — Fellers, Snider, Blankenship, Bailey & Tippens, P.C.; Terry L. Watt

(57) ABSTRACT

A method of adaptive guiding of a web on a roller is disclosed. The method includes computing an output of a reference model, reading an output of a sensor that indicates a web position, determining a difference between the output of the reference model and the output of the sensor, and updating a set off controller parameters for the roller based on the difference.

4 Claims, 8 Drawing Sheets

METHOD FOR ADAPTIVE GUIDING OF WEBS

CROSS REFERENCE TO RELATED APPLICATIONS

This application claims the priority of U.S. Provisional Patent Application No. 61/303,878 entitled "METHOD FOR ADAPTIVE GUIDING OF WEBS," filed Feb. 11, 2010, the contents of which are hereby incorporated by reference.

THE NAMES OF THE PARTIES TO A JOINT RESEARCH AGREEMENT

The invention set forth in this patent application was made as a result by or on behalf of Oklahoma State University, an institute of higher education of the State of Oklahoma, and Fife Corporation, a corporation duly organized under the laws of the State of Delaware and having a principal place of business at 222 West Memorial Road, Oklahoma City, Okla. 73114, who are parties to a joint research agreement that was in effect on or before the date the claimed invention was made. The claimed invention was made as a result of activities undertaken within the scope of the joint research agreement.

FIELD OF THE INVENTION

This disclosure relates to web handling systems in general and, more specifically, to web guide systems.

BACKGROUND OF THE INVENTION

The term "web" is used to describe materials having a length considerably larger than a width, and a width considerably larger than a thickness. Webs are materials manufactured and processed in a continuous, flexible strip form. Webs consist of a broad spectrum of materials that are used extensively in everyday life such as plastics, paper, textile, metals and composites. Web materials may be manufactured into rolls since it is easy to transport and process the materials in the rolled form.

Web handling is a term that is used to refer to the study of the behavior of the web while it is transported and controlled through the processing machinery from an unwind roll to a rewind roll. A typical operation involves transporting a web in rolled, unfinished form from an unwind roll to a rewind roll through processing machinery where the required processing operations are performed. An example of such a process is commonly seen in the metals industries. The web (metal strip) to be processed is transported on rollers to various sections where different operations like coating, painting, drying, slitting, etc., are performed. The process line generally has unwind and rewind rolls, many idle rollers and one or more intermediate driven rollers.

SUMMARY OF THE INVENTION

The invention of the present disclosure, in one embodiment thereof comprises a method of adaptive guiding of a web on a roller. The method includes utilizing a model equation, said model equation at least approximately representing a position of the web on the roller, said model equation being characterized by a plurality of parameters including a regressor vector, a filtered regressor vector, and a controller parameter vector, and setting at least a portion of said plurality of parameters of the model equation equal to initial values. The initial values may be zero.

The method includes measuring an actual position of the web on the roller, and calculating a difference $e_1$ between an output of the model equation and the actual position of the web. The method includes computing a new value for said regressor vector using at least said actual position of the web on the roller, a control input value on the roller, and a desired web position, and computing a value for said filtered regressor vector from said regressor vector. A value for a controller parameter vector derivative is calculated using at least $e_1$ and said filtered regressor.

When $e_1$ is greater than a predetermined constant or the controller parameter vector derivative is different from zero by more than a predetermined amount, the method includes updating the control parameters by integrating the controller parameter vector derivative. A new control input is provided to the roller based on the control parameters.

In some embodiments, the plurality of parameters further comprises a filtered regressor vector. The control parameters may be frozen when $e_1$ is less than a predetermined constant and the controller parameter vector derivative is different from zero by less than a predetermined amount.

The measured actual position of the web on the roller may comprise the actual position of the web on an end pivot guide roller, a center pivot guide roller, an offset pivot guide roller, and/or a remotely pivoted guide roller.

DETAILED DESCRIPTION OF THE PREFERRED EMBODIMENTS

The longitudinal dynamics of the web is the behavior of the web in the direction of transport of the web. Web transport velocity and web tension are two key variables of interest that affect the longitudinal behavior of the web. The lateral dynamics of the web is the behavior of the web perpendicular to the direction of transport of the web and in the plane of web. Several parameters affecting the lateral web dynamics include web material, tension, transport velocity, and web geometry, etc. The quality of the finished web depends on how well the web is handled on the rollers during transport. The longitudinal and lateral control of the web on rollers plays a critical role in the quality of the finished product.

One focus of the embodiments described in this disclosure is control of lateral dynamics of a web. Adaptive control strategies capable of providing the required performance in the presence of the variations in the process and web parameters are disclosed. The suitability of these control strategies and their ability to provide the required performance are described, both from theoretical and experimental perspectives.

Web guiding (also called lateral control) involves controlling web fluctuations in the plane of the web and perpendicular to web travel. Web guiding is important because rollers in any web handling machinery tend to have misalignment problems that may cause the web to move laterally on the rollers. Lateral movement of the web on the rollers may produce wrinkles or slackness in the web or the web may completely fall off the rollers. A number of web processes such as printing, coating and winding may be affected by web lateral motion. Web guides may be used to maintain the lateral position of the web on rollers during transport.

Figure 1:
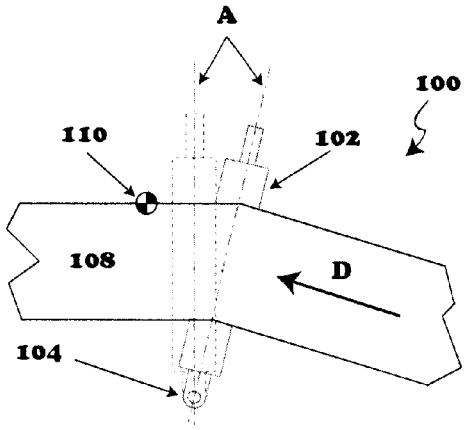
FIG. 1 is an overhead view of an end pivoted web guide.

Referring now to FIG. 1, where an overhead view of an end pivot web guide is shown, it can be seen that a web guide mechanism 100 may comprise a roller 102 sitting on a pivoted base 104. The base 104 is controlled to change the axis of rotation 'A' of the roller 102. A web 108 approaching the roller 102 (here shown in direction 'D') will tend to orient itself perpendicular to the axis of rotation 'A' of the roller 102. The lateral motion of the web 108 is controlled by changing the axis of rotation 'A' of the guide roller 102. The lateral position of the web 108 is measured using one or more sensors 110. Based on this measurement as feedback the axis of rotation 'A' of the guide roller b02 is controlled to maintain the lateral position at the required location.

The sensor 110 can be any suitable type of sensor capable of determining the position of the web 108. For example, the sensor 110 can be an edge sensor positioned adjacent to the edge of the web 108, or a line sensor sensing the location of a predetermined pattern printed on or formed in the web 108. The sensor 110 can use a variety of different types of sensing media depending upon the type of web 108 or the environment in which the web 108 is to be sensed. Exemplary sensing media include light, sound, air, electrical properties (proximity sensor) or the like. It should be understood that the sensor(s) 110 is shown by way of example as an edge sensor positioned downstream of a roller. However, this can be varied depending upon the circumstances. For example, the sensor 110 can be a line sensor sensing the position of the web 108 as it passes across a roller.

Web guides may be positioned at different locations in an industrial process line where guiding is required. Guides located at either ends in a process line are usually called terminal guides. An unwind guide maintains the lateral position of the web which is fed into the processing line, whereas a rewind guide maintains the lateral position of the processed web wound onto a roll in the rewind section. Apart from terminal guiding, web guides are extensively used in the intermediate process sections and they are referred to as intermediate guides.

Figure 2:
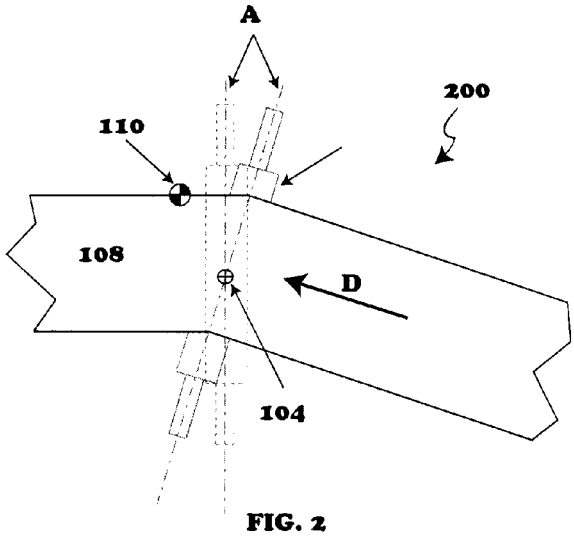
FIG. 2 is an overhead view of a center pivoted web guide.

Intermediate web guides are classified based on the way in which the axis of rotation of the guide roller is changed. FIG. 1 shows an end pivoted guide 100 where the change in the axis of rotation 'A' of the roller 102 is about a pivot point 104, which is at one end of the roller. The center pivoted guide 200 shown in FIG. 2 has its pivot point 104 in the center of the guide roller 102.

Figure 3A:
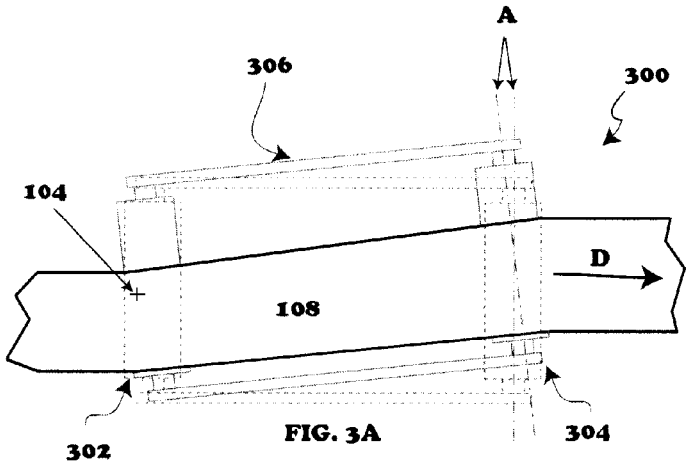
FIG. 3A is an overhead view of an offset pivot web guide.
Figure 3B:
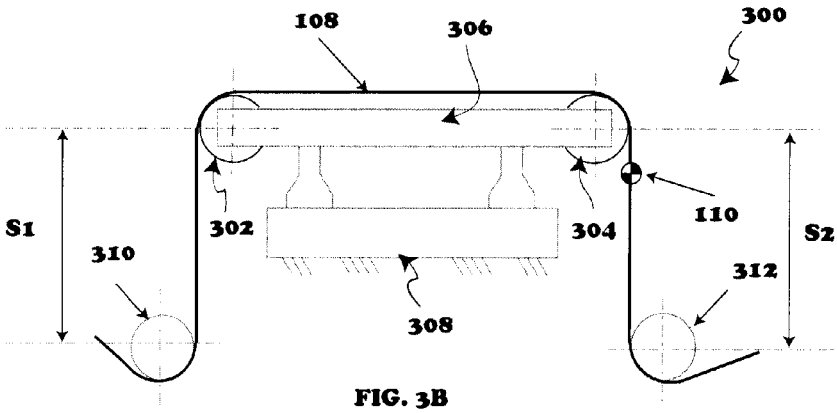
FIG. 3B is a side view of an offset pivot web guide.

Referring now to FIGS. 3A-3B, overhead and side views, respectively of an offset-pivot guide are shown. The offset-pivot guide 300 utilizes a pair of rollers 302, 304 mounted on a pivot carrier 306 to change the axis of rotation 'A'. From FIG. 3B it can be seen that the pivot carrier itself may be mounted on a base 308. Fixed rollers 310, 312 may handle the web 108 on either side of the guide 300. The length of span between the fixed roller 310 and the roller 302 is shown as S1, while the length of the span between the fixed roller 312 and the roller 306 is shown as S2.

Figure 4A:
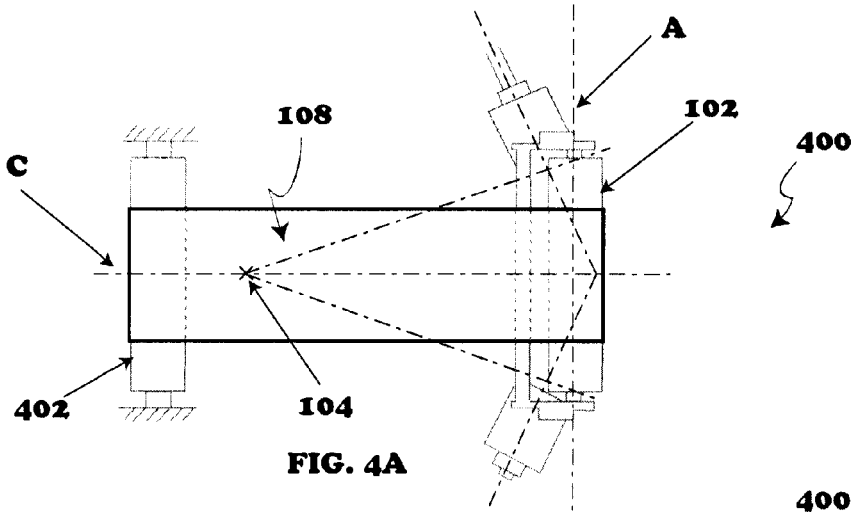
FIG. 4A is an overhead view of a remotely pivoted web guide.
Figure 4B:
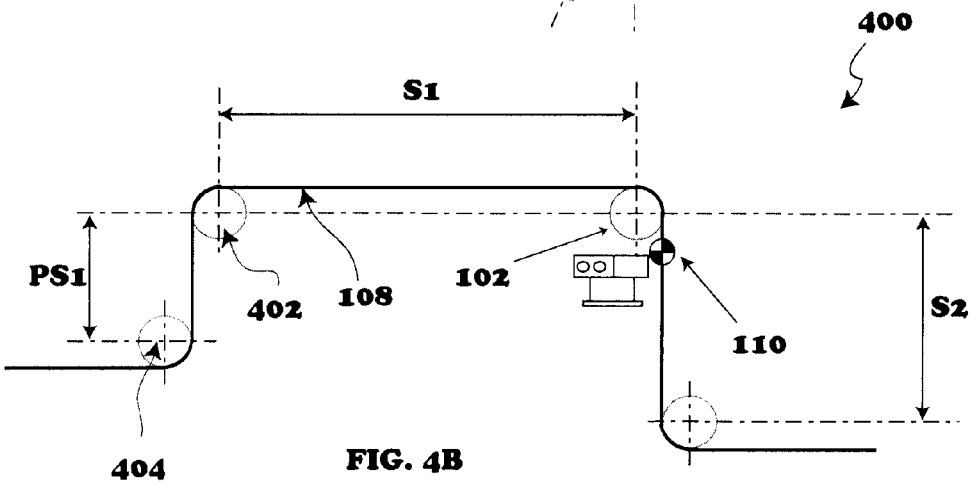
FIG. 4B is a side view of a remotely pivoted web guide.

Referring now to FIGS. 4A-4B an overhead and side views, respectively, of a remotely pivoted guide are shown. In remotely pivoted guide 400, the guide roller 102 moves along a curved path to change its axis 'A'. The centerline 'C' of the machine is shown relative to a fixed roller 402. A pre-entering span PS1 between two fixed rollers 402, 404 is shown, as is the entering span S1 between the fixed roller 402 and the guide roller 102. The edge sensor 110 can be downstream of the guide roller 102 on the exit span S2.

Lateral Dynamics

Lateral and longitudinal dynamics of a moving web are dependent on various process parameters like transport velocity, web tension, web material, and the geometry of the web material, etc. Two of the types of intermediate guides that are considered in this disclosure are remotely pivoted guides (steering guides) and offset-pivot guides (displacement guides). The web span lateral dynamics for the two guides are similar and hence the same controller design may be implemented on both the guides. Even though the present disclosure focuses on these two intermediate guides, the methods and systems disclosed can be adapted to other guides and to unwind/rewind guiding.

Lateral Control

Lateral control involves the design of a closed-loop control system for regulating the lateral position of the web in a process line using a web guide mechanism. As described above, the guide mechanism includes an actuator, which provides the input to the system and a feedback sensor, which is used to measure the lateral position of the web.

The following symbols used herein are defined as follows:

$C_m$ transmission ratio
e error
$e_1$ tracking error
E modulus of elasticity of web
$Q_1$ estimation error
F friction force
$F_c$ Coulomb friction coefficient
$F_s$ static friction coefficient
$F_v$ viscous friction coefficient
$\gamma$ gain
$\Gamma$ gain matrix
i current
I moment of inertia
J rotor inertia
$k_m$ motor parameter or high frequency gain for a reference model
$k_p$, high frequency gain for a plant model $$K = \sqrt{\frac{T}{EI}}$$

web span parameter
$K_e$ back electromotive force constant
$K_t$ torque constant/sensitivity
L inductance or length of span
$L_1$ distance from the guide roller to instant center
£ Laplace operator
$£^{-1}$ inverse Laplace operator
μ mean
n* relative degree
ω regressor vector
$\omega_n$ natural frequency
$W_m(s)$ reference model transfer function
ϕ filtered regressor vector
r reference command
R resistance
$R_m(s)$ denominator polynomial of reference model
$R_p(s)$ denominator polynomial of plant model
R set of all real numbers
sgn(.) signum function
σ standard deviation
$\sigma^2$ variance
T torque or Tension
τ time constant
θ controller parameter vector
θ* true parameter vector
$\theta_0$ roller misalignment
u, $U_p$ input to a plant
v velocity
$v_s$ Stribeck velocity constant
x state variable
$x_1$ distance from the guide roller to the instant center
y output of a plant
ŷ estimator output
$Y_0$ initial lateral position misalignment
$y_L$, $Y_L$ lateral edge position
$y_m$ output of a reference model
ζ damping ratio
Z guide position
$Z_m(s)$ numerator polynomial of reference model
$Z_p(s)$ numerator polynomial of plant model Herein, the derivation of lateral dynamics of a web guided by different kinds of guides, and for the most general boundary conditions, is discussed. The transfer functions for the remotely pivoted guide (RPG) and the offset pivot guide (OPG), which have been used to demonstrate the adaptive method, have been derived and implemented. These transfer functions will also be useful in finding out the estimates of the controller parameters. The model derivation is based on the beam theory, as described by J. J. Shelton in "Lateral dynamics of a moving web," Ph.D. dissertation, Oklahoma State University, Stillwater, 1968, hereby incorporated by reference.

The web elastic curve between two rollers can be described using the following fourth order differential equation.

$$\frac{\partial^4 y}{\partial x^4} - K^2 \frac{\partial^2 y}{\partial x^2} = 0 \tag{1}$$

where the parameter K is defined as $$K^2 = \frac{T}{EI} \tag{2}$$

with
T=Tension
E=Modulus of elasticity
I=Moment of Inertia

Equation (1) can be derived from the beam theory assuming that the web mass is negligible. At any given time, the general solution to the equation can be written as:

$$y = C_1 \sin hKx + C_2 \cos hKx + C_3 x + C_4 \tag{3}$$

where the constant coefficients $C_1$, $C_2$, $C_3$, and $C_4$ are obtained using the boundary conditions. To obtain these coefficients, we need four boundary conditions. Considering the most general case, which combines the effects of translation and rotation of the web, the boundary conditions are given as follows (see G. E. Young and K. N. Reid, "Lateral and Longitudinal Dynamic Behavior and Control of Moving Webs," Journal of Dynamic Systems, Measurement, and Control, vol. 115, pp. 309-317, June 1993, hereby incorporated by reference):

$$\begin{aligned} y|_{x=0} &= y_0, \\ \left.\frac{\partial y}{\partial x}\right|_{x=0} &= \theta_{w0}, \\ y|_{x=L} &= y_L, \\ \left.\frac{\partial y}{\partial x}\right|_{x=L} &= \theta_{wL}, \end{aligned} \tag{4}$$

The coefficients $C_1$, $C_2$, $C_3$, and $C_4$ under the above boundary conditions are $$\begin{aligned} C_1 &= \frac{\theta_{wL}(\cosh KL - 1) + \theta_{w0}(KL\sinh KL - \cosh KL + 1) - (yL - y0)K\sinh KL}{K[KL\sinh KL - 2(\cos hKL - 1)]} \\ C_2 &= \frac{\theta_{wL}(KL - \sinh KL) + \theta_{w0}(\sinh KL - \cosh KL) + (yL - y0)K(\cosh KL - 1)}{K[KL\sinh KL - 2(\cosh KL - 1)]} \\ C_3 &= \theta_{w0} - C_1 K \\ C_4 &= y_0 - C_2 \end{aligned} \tag{5}$$

To derive the lateral dynamics of the web guide the following equations, based on the fact that a moving free web aligns itself perpendicularly to a given roller in steady state condition, were introduced by Shelton.

$$\frac{dy_i}{dt} = v\left(\theta_i - \left.\frac{\partial y}{\partial x}\right|_{x=i}\right) + \frac{dz_i}{dt}, \tag{6}$$

$$\frac{d^2 y_i}{dt^2} = v^2 \left.\frac{\partial^2 y}{\partial x^2}\right|_{x=i} + \frac{d^2 z_i}{dt^2}, \tag{7}$$

where $y_i$ is the displacement of the web at the $i^{th}$ roller, $z_i$ is the roller displacement, $\theta_i$ is the roller angle and v is the longitudinal velocity of the web. For any web span, i=0 for an upstream roller and i=L for the downstream roller. Note that (7) is not merely a derivative of (6) because of the assumption that the shear deformation is negligible.

Differentiating (3) twice and substituting the values of the coefficients (5), we get $$\left.\frac{\partial^2 y}{\partial x^2}\right|_{x=L} = K^2[C_1\sinh(KL) + C_2\cosh(KL)] = \frac{1}{L^2}f_1(KL)(y_0 - y_L) + \frac{1}{L}f_2(KL)\theta_{wL} + \frac{1}{L}f_3(KL)\theta_{w0}, \tag{8}$$

where $$f_1(KL) = \frac{(KL)^2(\cosh KL - 1)}{[KL\sinh KL - 2(\cosh KL - 1)]},$$

$$f_2(KL) = \frac{KL(KL\cosh KL - \sinh KL)}{[KL\sinh KL - 2(\cosh KL - 1)]},$$

$$f_3(KL) = \frac{KL(\sinh KL - KL)}{[KL\sinh KL - 2(\cosh KL - 1)]}.$$

Using the boundary conditions (4) and the Equation (6), we get $$\theta_{wi}(t) = \left.\frac{\partial y}{\partial x}\right|_{x=i} = \theta_i + \frac{1}{v}\frac{dz_i}{dt} - \frac{1}{v}\frac{dy_i}{dt} \tag{9}$$

Now using the above equations, (9) and (8) in (7), the lateral web acceleration at the roller $y_L$ can be written as $$\frac{d^2 yL}{dt^2} = -\frac{f_1}{\tau^2}yL - \frac{f_2}{\tau}\frac{dyL}{dt} + \frac{f_1}{\tau^2}y_0 - \frac{f_3}{\tau}\frac{dy_0}{dt} + \frac{f_2V^2}{L}\theta_L + \frac{f_3V^2}{L}\theta_0 + \frac{f_2}{\tau}\frac{dz_L}{dt} + \frac{d^2z_L}{dt^2} + \frac{f_3}{\tau}\frac{dz_0}{dt} \tag{10}$$

Applying Laplace transform to both sides a second-order transfer function of a real moving web under general boundary conditions can be obtained.

$$s^2Y_L(s) = -\frac{f_1}{\tau^2}Y_L(s) - s\frac{f_2}{\tau}Y_L(s) + \frac{f_1}{\tau^2}Y_0(s) - s\frac{f_3}{\tau}Y_0(s) + \frac{f_2V^2}{L}\theta_L(s) + \frac{f_3V^2}{L}\theta_0(s) + s\frac{f_2}{\tau}Z_L(s) + s^2Z_L(s) + s\frac{f_3}{\tau}Z_0(s) \tag{11}$$

$$Y_L(s) = \left(\frac{-\frac{f_3(KL)}{\tau}s + \frac{f_1(KL)}{\tau^2}}{s^2 + \frac{f_2(KL)}{\tau}s + \frac{f_1(KL)}{\tau^2}}\right)Y_0(s) + \left(\frac{\frac{f_2(KL)}{\tau}}{s^2 + \frac{f_2(KL)}{\tau}s + \frac{f_1(KL)}{\tau^2}}\right)\theta_L(s) + \left(\frac{\frac{f_2(KL)L}{\tau}}{s^2 + \frac{f_2(KL)}{\tau}s + \frac{f_1(KL)}{\tau^2}}\right)\theta_0(s) + \left(\frac{s^2 + \frac{f_2(KL)}{\tau}s}{s^2 + \frac{f_2(KL)}{\tau}s + \frac{f_1(KL)}{\tau^2}}\right)Z_L(s) + \left(\frac{\frac{f_3(KL)}{\tau}s}{s^2 + \frac{f_2(KL)}{\tau}s + \frac{f_1(KL)}{\tau^2}}\right)Z_0(s) \tag{2}$$

Lateral dynamics for different types of situations are given below.

Fixed Rollers

Figure 5:
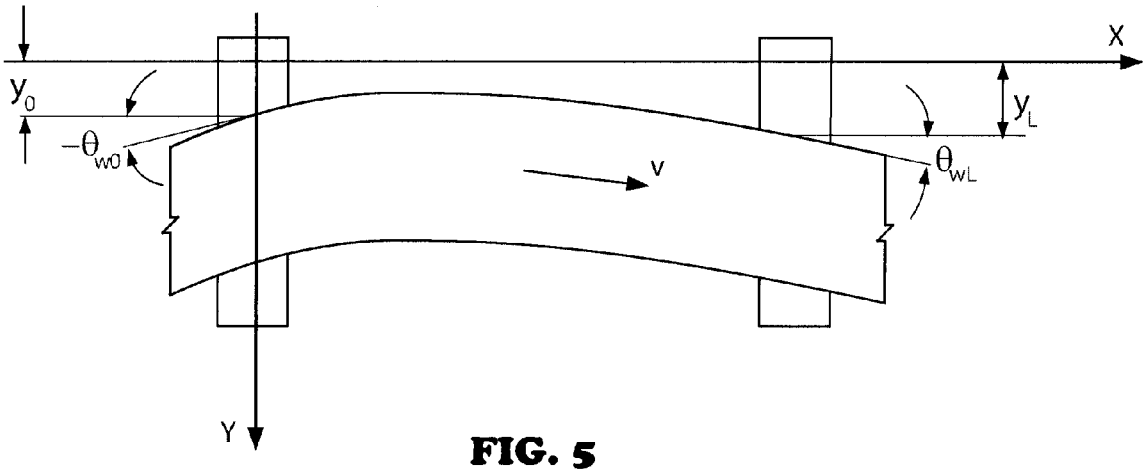
FIG. 5 is a schematic diagram of web boundary conditions.

A schematic diagram of the boundary conditions between two fixed rollers is shown in FIG. 5. The lateral motion of the two rollers, $Z_L$ and $Z_0$, is zero. We can consider a small misalignment of the rollers to be present. Let the upstream roller and the downstream roller be inclined at angles $\theta_L$ and $\theta_0$, respectively, with the Y-axis. The transfer function, considering the disturbance at the upstream roller as $Y_0(s)$, is $$Y_L(s) = \left(\frac{-\frac{f_3(KL)}{\tau}s + \frac{f_1(KL)}{\tau^2}}{s^2 + \frac{f_2(KL)}{\tau}s + \frac{f_1(KL)}{\tau^2}}\right)Y_0(s) + \left(\frac{\frac{f_2(KL)L}{\tau^2}}{s^2 + \frac{f_2(KL)}{\tau}s + \frac{f_1(KL)}{\tau^2}}\right)\theta_L(s) + \left(\frac{\frac{f_3(KL)L}{\tau^2}}{s^2 + \frac{f_2(KL)}{\tau}s + \frac{f_1(KL)}{\tau^2}}\right)\theta_0(s) \tag{3}$$

where $\tau = \frac{L}{v}$ is the transport lag.

Center/End Pivoted Guide

Figure 6:
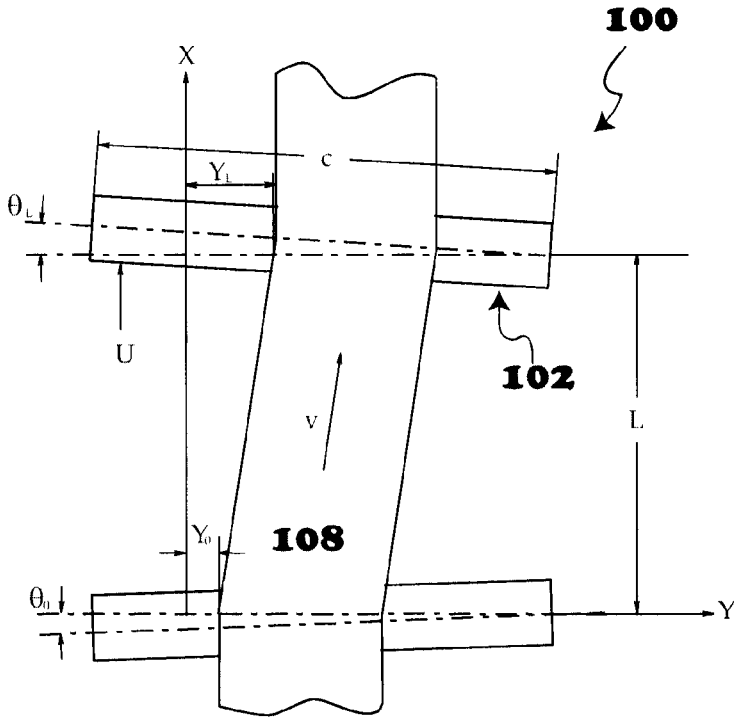
FIG. 6 is a schematic of the response of a web at an end pivoted steering guide.

FIG. 6 is a schematic of the variables of the web 108 on the end pivoted guide 100. The end pivoted guide 100 or center pivoted guide 200 rotates about a fixed pivot located along the axis of the guide roller 102. We can assume the roller upstream of the guide roller 102 to be fixed and at an angle $\theta_0$ with the Y-axis. The input to the guide roller 102 is the displacement provided at the moving end of the roller, $u=\theta_L c$, along the longitudinal direction, where c is the distance from the moving end to the pivot point 104 of the guide roller 102. The transfer function is given as:

$$Y_L(s) = \left(\frac{\frac{f_3(KL)L}{\tau^2}}{s^2 + \frac{f_2(KL)}{\tau}s + \frac{f_1(KL)}{\tau^2}}\right)\theta_0(s) + \left(\frac{-\frac{f_3(KL)}{\tau}s + \frac{f_1(KL)}{\tau^2}}{s^2 + \frac{f_2(KL)}{\tau}s + \frac{f_1(KL)}{\tau^2}}\right)Y_0(s)\left(\frac{\frac{f_2(KL)L}{\tau^2 c}}{s^2 + \frac{f_2(KL)}{\tau}s + \frac{f_1(KL)}{\tau^2}}\right)U(s) \tag{14}$$

Remotely Pivoted Steering Guide

Figure 7:
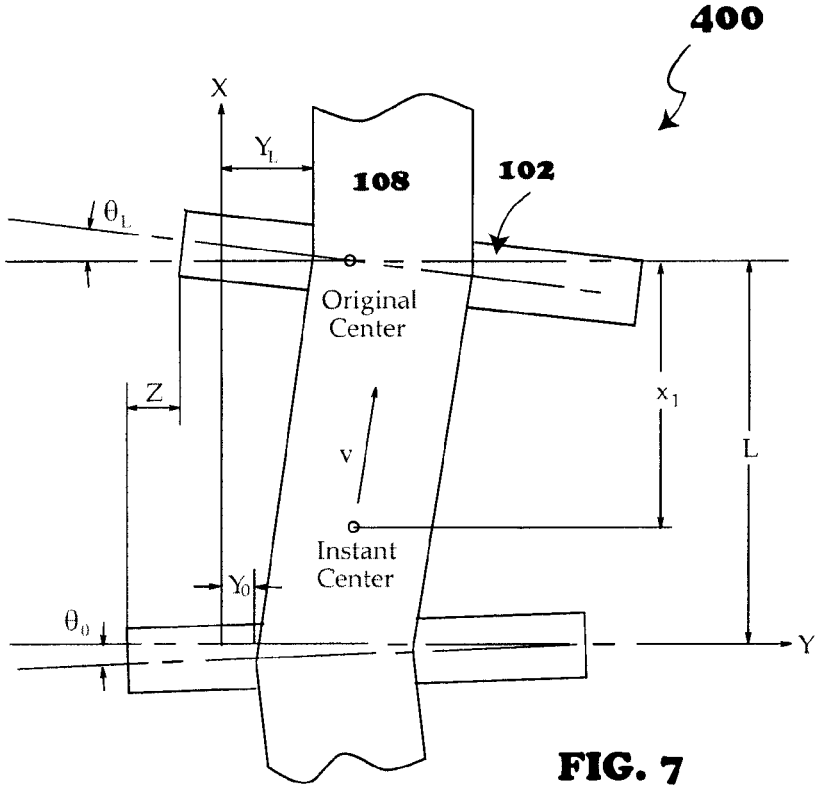
FIG. 7 is a schematic of the response of a web at a remotely pivoted steering guide.

FIG. 7 is a schematic of the response of the web 108 at the remotely pivoted steering guide 400. The input to the guide 400 is the lateral motion z, provided along the Y-axis. Due to this lateral motion the guide roller 102 moves along an arc, creating an angle with the longitudinal direction $$\theta_L = \frac{z}{x_1},$$

with $x_1$ as the distance from the roller to the instantaneous center of the roller's rotation. Using this condition, the transfer function can be given by, $$Y_L(s) = \left(\frac{s^2 + \frac{f_2(KL)}{\tau}s + \frac{f_2(KL)L}{\tau^2 x_1}}{s^2 + \frac{f_2(KL)}{\tau}s + \frac{f_1(KL)}{\tau^2}}\right)Z(s) + \left(\frac{\frac{f_3(KL)L}{\tau^2}}{s^2 + \frac{f_2(KL)}{\tau}s + \frac{f_1(KL)}{\tau^2}}\right)\theta_0(s) + \tag{15}$$

-continued $$\left(\frac{-\frac{f_3(KL)}{\tau}s+\frac{f_1(KL)}{\tau^2}}{s^2+\frac{f_2(KL)}{\tau}s+\frac{f_1(KL)}{\tau^2}}\right)Y_0(s)$$

$$Y_L(s)=G_1(s)Z(s)+G_2(s)\theta_0(s)+G_3(s)Y_0(s)$$

The variables $\theta_0(s)$ and $Y_0(s)$ are considered as the disturbances, and the objective of the web guide 400 is to reject these disturbances to maintain the lateral position downstream of the web guide 400. Thus the effect of the input guide displacement, Z(s), to the lateral position of the web 108, $Y_L(s)$, is given by $$Y_L(s)=\frac{s^2+\beta_2 s+B_1}{s^2+\beta_2 s+\beta_0}Z(s) \tag{16}$$

where $$\beta_0=\left(\frac{1}{\tau^2}\right)\frac{(KL)^2(\cosh KL-1)}{KL\sinh KL-2(\cosh KL-1)}\triangleq\left(\frac{1}{\tau^2}\right)f_1(KL) \tag{17}$$

$$\beta_1=\left(\frac{1}{\tau^2 x_1}\right)\frac{KL(KL\cosh KL-\sinh KL)}{KL\sinh KL-2(\cosh KL-1)}\triangleq\left(\frac{1}{\tau^2 x_1}\right)f_2(KL)$$

$$\beta_2=\left(\frac{1}{\tau}\right)\frac{KL(KL\cosh KL-\sinh KL)}{KL\sinh KL-2(\cosh KL-1)}\triangleq\left(\frac{1}{\tau}\right)f_2(KL)$$

Offset Pivot Guide

Figure 8B:
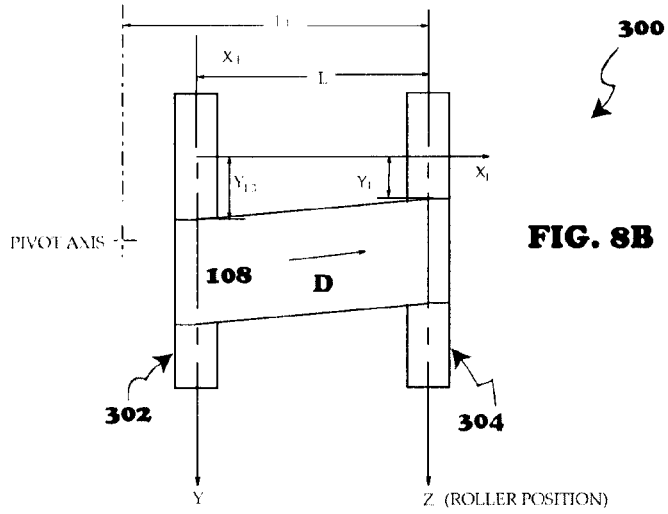
FIG. 8B is a schematic of the response of a web between B and C rollers of an offset pivot guide.
Figure 8A:
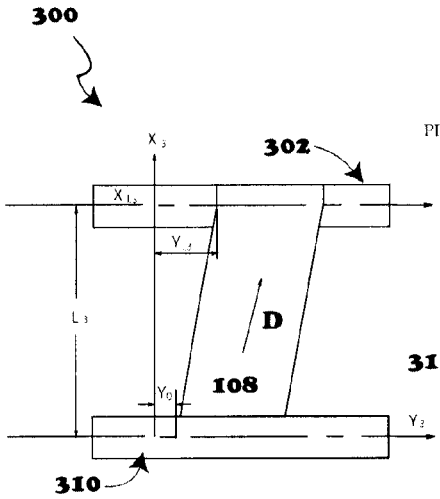
FIG. 8A is a schematic of the response of a web between A and B rollers of an offset pivot guide.
Figure 8C:
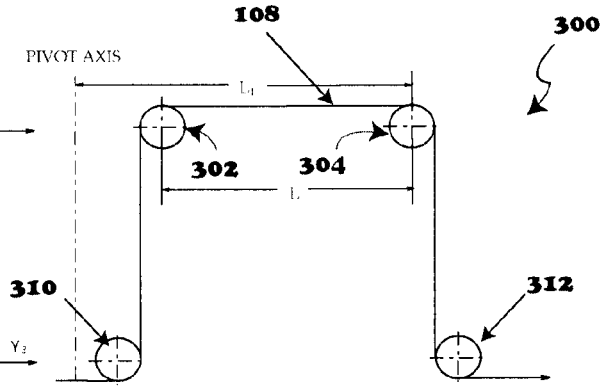
FIG. 8C is a side view schematic of a web traversing an offset pivot guide.

FIGS. 8A-8C illustrate the response of the web 108 across the various rollers 302, 304, 310 and 312 of an offset pivot guide 300. In FIGS. 8A-8C, 'B' and are the rollers 302 and 304 of the offset pivot guide 300, while 'A' is the upstream roller 310. L is the span between the two guide rollers 302 and 304, $L_3$ is the span between roller B and roller A and $L_1$ is the instantaneous center of rotation for the two guide rollers B and C. Let the lateral motion of the roller C be z and the web displacement at roller C be $y_L$. Hence, roller B will have the lateral motion of $(1-L/L_1)z$. To build the transfer function from z to $y_L$, we have to consider the effect of simultaneous lateral motion of roller B also. Let the displacement $(1-L/L_1)z$ of roller B produce a lateral web displacement of $y_0$ at that roller. This in turn affects the web lateral displacement at C, $y_L$. Thus, the web displacement at the guide roller C is because of the movement of the roller C itself, and also because of the simultaneous movement of roller B. Hence the transfer function can be given by the following equation:

$$Y_L(s)= \tag{18}$$

$$\left(\frac{\left(-\frac{f_3(KL_3)}{\tau_3}s+\frac{f_1(KL_3)}{\tau_3^2}\right)\left(-\frac{f_3(KL)}{\tau}s+\frac{f_1(KL)}{\tau^2}\right)}{\left[s^2+\frac{f_2(KL_3)}{\tau_3}s+\frac{f_1(KL_3)}{\tau_3^2}\right]\left[s^2+\frac{f_2(KL)}{\tau}s+\frac{f_1(KL)}{\tau^2}\right]}\right)Y_0(s)+$$

$$\left(\frac{\left(-\frac{f_3(KL_3)}{\tau}s+\frac{f_1(KL_3)}{\tau^2}\right)\left[s^2+\frac{f_2(KL)}{\tau_3}s\right]\frac{L_1-L}{L_1}}{\left[s^2+\frac{f_2(KL_3)}{\tau_3}s+\frac{f_1(KL_3)}{\tau_3^2}\right]\left[s^2+\frac{f_2(KL)}{\tau}s+\frac{f_1(KL)}{\tau^2}\right]}+\frac{s^2+\frac{f_2(KL)}{\tau}s+\frac{f_2(KL)}{\tau^2}\frac{L}{L_1}}{\left[s^2+\frac{f_2(KL)}{\tau}s+\frac{f_1(KL)}{\tau^2}\right]}\right)Z(s),$$

-continued where $\tau_3=\frac{L_3}{v}$ and $\tau=\frac{L}{v}$.

Notice that the denominator of the transfer function (18) is a polynomial of degree 4. The increase in the order is because of the dynamics of the extra web span between the two guide rollers B and C. Also, the two rollers A and B are parallel when viewed perpendicularly to the centerline of the web, throughout the motion of B. Hence, $\theta_0$ can be taken as zero.

Note that when $L=L_1$ and $Y_0=0$, the transfer function for the OPG can be given by $$Y_L(s)=\left(\frac{s^2+\frac{f_2(KL)}{\tau}s+\frac{f_2(KL)}{\tau^2}}{s^2+\frac{f_2(KL)}{\tau}s+\frac{f_1(KL)}{\tau^2}}\right)Z(s), \tag{19}$$

which is a second order equation with relative degree zero.

Response at a Downstream Roller Due to Input at the Steering Guide Roller

Considering the RPG, the displacement of the guide z, causes the web displacement of at that roller. This, in turn, affects the web lateral position at the downstream roller $y_{L+1}$. Hence, the two transfer functions can be cascaded to get the net effect of z on $y_{L+1}$.

$$Y_L(s)=\left(\frac{s^2+\frac{f_2(KL)}{\tau}s+\frac{f_2(KL)L}{\tau^2 x_1}}{s^2+\frac{f_2(KL)}{\tau}s+\frac{f_1(KL)}{\tau^2}}\right)Z(s) \tag{20}$$

$$Y_{L+1}(s)=\left(\frac{-\frac{f_3(KL)}{\tau_g}s+\frac{f_1(KL_g)}{\tau_g^2}}{s^2+\frac{f_2(KL_g)}{\tau_g}s+\frac{f_1(KL_g)}{\tau_g^2}}\right)Y_L(s) \tag{21}$$

Hence, we have $$Y_{L+1}(s)=\left(\frac{-\frac{f_3(KL_g)}{\tau_g}s+\frac{f_1(KL_g)}{\tau_g^2}}{s^2+\frac{f_2(KL_g)}{\tau_g}s+\frac{f_1(KL_g)}{\tau_g^2}}\right)\left(\frac{s^2+\frac{f_2(KL)}{\tau_g}s+\frac{f_2(KL)L}{\tau_g^2}}{s^2+\frac{f_2(KL)}{\tau}s+\frac{f_1(KL)}{\tau^2}}\right)Z(s) \tag{22}$$

Here, $\tau$ is the time constant of the guide roller's entering span and $\tau_g$ is the time constant for the guide roller's exiting span.

Unwind Guiding

Figure 9:
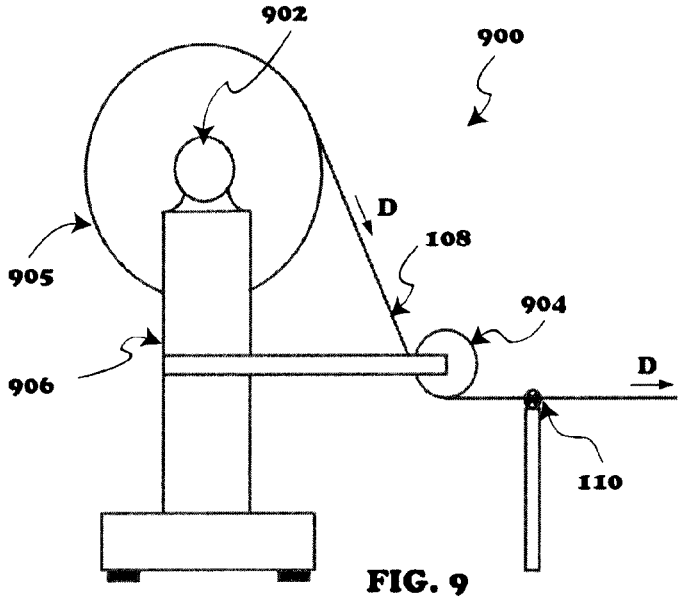
FIG. 9 is a side view of an unwind guide.

Referring now to FIG. 9, a side view of an unwind guide 900 at least one having an unwind roll 902 and idler roller 904 is shown. Unwind guiding is required to align the web 108 that is being released from a roll of web material 905 to the process sections of the line. The roll of web material is positioned on and supported by the unwind roll 902. Unwind guiding is accomplished by lateral motion of the unwind roll stand 906. The idler roller 904 fixed to the unwind roll 902 which places the web surface in the correct plane as the web enters the process line. The sensor 110 may be fixed to the ground (or other non-moving object) and preferably does not move with the unwind roll 902 and the idler 904. The sensor 110 may be placed very close to the idler roller 904 but in some applications this may not be possible. If the sensor 110 is placed after one web span from the idler 904, the sensor output cannot be assumed to indicate the web edge position on the guide roller and we have to consider the effect of web dynamics of the additional span.

Figure 10:
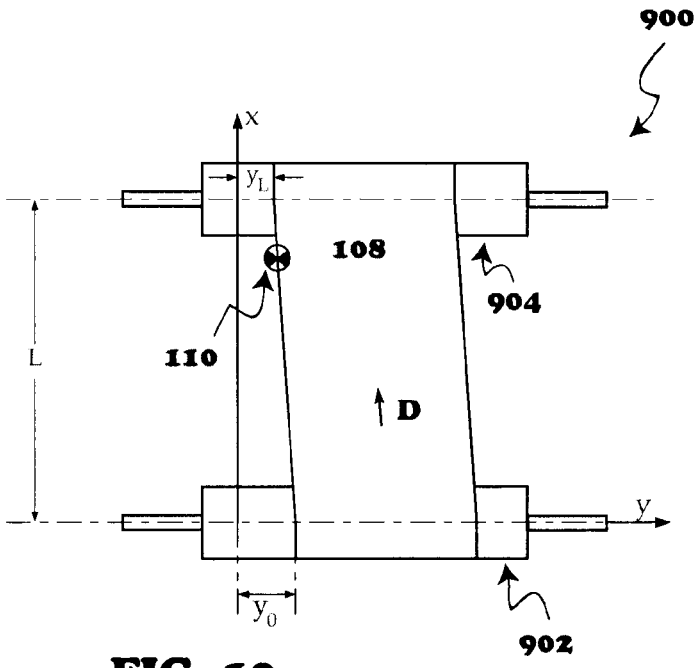
FIG. 10 is a schematic diagram of the response of a web at an unwind guide.

Referring now to FIG. 10, a schematic diagram of the response of the web 108 at the unwind guide 900 is shown. Let $z_0$ be the displacement of the unwind guide setup, which is perpendicular to the plane of the drawing in FIG. 9. Let $y_0$ be the displacement of the web 108 on the unwind roller 902 with respect to the ground. As the roller moves along with the unwind stand, we have $Z_0(s)=Y_0(s)$ and assuming $\theta_L(s)=\theta_0(s)=Z_L(s)=0$ in the Equation (12), we can write the second order dynamics of the web as $$Y_L(s) = \left(\frac{\frac{f_1(KL)}{\tau^2}}{s^2 + \frac{f_2(KL)}{\tau}s + \frac{f_1(KL)}{\tau^2}}\right)Z_0(s) \tag{23}$$

where $y_L$ represents the lateral displacement of the web 108 at the roller downstream of the idler roller 904 (FIG. 10). Note that the position of web edge on the idler roller 904 is same as the position of the web edge on the unwind roller 902.

To consider the complete dynamic model of the unwind guide 900, that is, to find the transfer function of the unwind guide 900 with force acting on it as an input and the displacement of the web 108 at the downstream roller as output, we have to consider the change in mass of the unwind roller 902 as it releases the web 108 over time.

Let the force acting on the roller be given by $$F = \frac{d}{dt}(m\dot{z}_0) + b\dot{z}_0 \tag{24}$$

where m is the mass of the whole unwind guide setup which is moving, $\dot{Z}_0$ is the velocity with which it moves and b is the friction coefficient. Simplifying, we get $$F = m\frac{d^2 z_0}{dt^2} + (\dot{m} + b)\frac{dz_0}{dt} \tag{25}$$

where $z_0$ is the displacement of the unwind guide 900. The mass m of the whole guide setup can be given by $$m=m_0+m_r, \tag{26}$$

where $m_r$ gives the changing mass of the roll of web material 905 on the unwind roll 902 and $m_0$ is the mass of the setup without the unwind roll 902, which is constant. Further, the mass of the unwind roll 902 can be written as $$m_r=\rho b_w\pi(R_0^2-R_c^2) \tag{27}$$

where $b_w$ is the web width, ρ is the density of the web material, $R_c$ is the radius of the empty core mounted on the unwind roll-shaft, and $R_0$ is the radius of the material roll. The time derivative of $m_r$ is given by, $$\frac{dm_r}{dt} = 2\rho b_w\pi(R_0\dot{R}_0). \tag{28}$$

The rate of change of the radius of the material roll is related to the longitudinal velocity $v_0$ and the web thickness, $t_w$, and can be given as follows:

$$\dot{R}_0 \approx -\frac{t_w}{2\pi}\frac{v_0(t)}{R_0(t)}. \tag{29}$$

Note that this relation is only approximate as the radius of the roll of web material 905 changes only after one complete rotation. The continuity can be assumed, as the thickness is usually very small compared the radius of the roll of web material 905. Using this relation, the rate of change of mass m of the whole guide setup can be given by, $$\dot{m} = \dot{m}_r = 2\rho b_w\pi R_0\left(-\frac{t_w}{2\pi}\frac{v_0}{R_0}\right) = -\rho b_w t_w v_0 \tag{30}$$

Now, using (30) in the equation (25) and taking the Laplace transforms, we can write the transfer function of the guide setup, with force acting on the unwind setup as input and the displacement of the unwind guide roller 902 as output, as $$Z_0(s) = \frac{1}{ms^2 + b_1 s}F(s) \tag{31}$$

where $b_1=(b-\rho b_w t_w v_0)$, and m can be estimated at each sampling time using the equation (30). This is derived under the assumption that the mass supported by the unwind roll 902 is varying slowly. If this is not true, we cannot take Laplace transforms since the coefficients of the governing differential equation are time-varying. Thus using the relations (31) and (23), the transfer function of the unwind guide roll 902 with force acting on it as input and displacement of the web 108 at the downstream roller as output can be given as, $$Y_L(s) = \left(\frac{\frac{f_1(KL)}{\tau^2}}{s^2 + \frac{f_2(KL)}{\tau}s + \frac{f_1(KL)}{\tau^2}}\right)\left(\frac{1}{ms^2 + b_1 s}\right)F(s) \tag{32}$$

Figure 11:
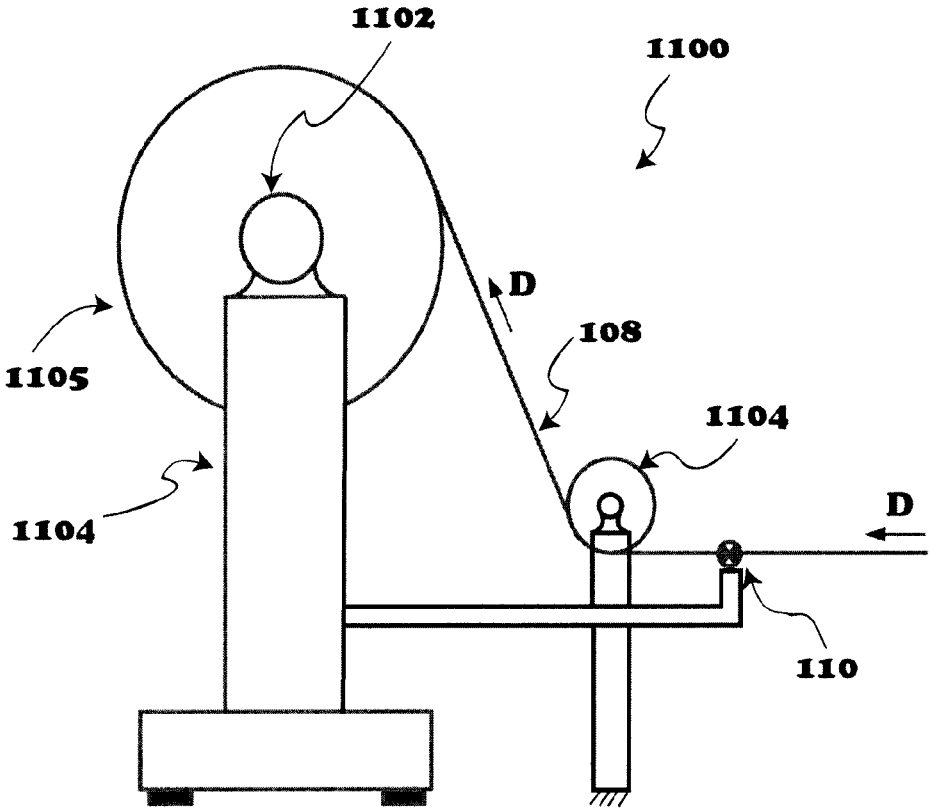
FIG. 11 is a side view of a rewind guide.

Referring now to FIG. 11 a side view of a rewind guide 1100 is shown. In rewind guiding, the web 108 is aligned on the rewind roll 1102, as it comes out of the web process line by moving the stand 1104 which supports the rewind roll 1102 laterally. In fact, rewind guiding is not actually "guiding" the web but chasing the web coming out of the process line. There exists at least one idler roller 904 fixed to the ground for example, and one sensor 110 fixed to the rewind guide setup so that the sensor 110 moves with the rewind roll 1102. Note that the displacement of the rewind guide stand 1104 is in the direction that is perpendicular to the plane of FIG. 11.

Figure 12:
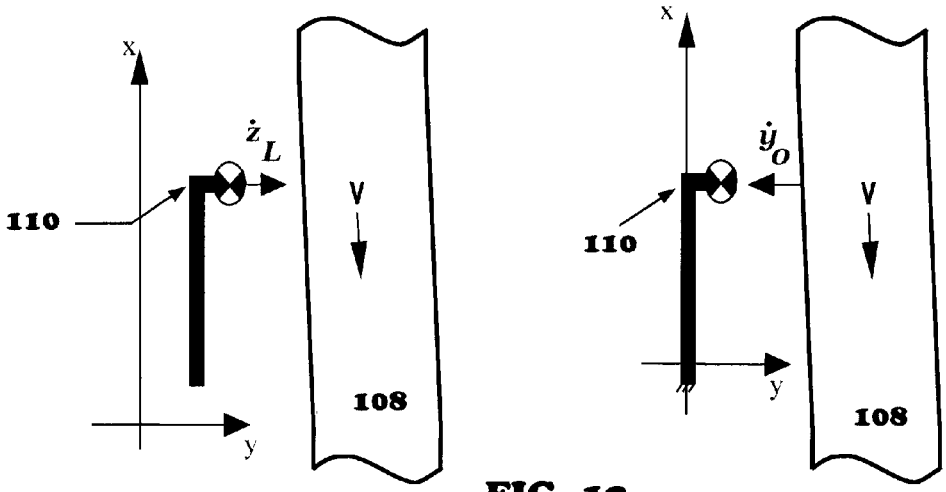
FIG. 12 is a diagram illustrating relative velocity between a sensor and a web.

As the sensor 110 is attached to the rewind guide 1104 and is placed before the idler roller 904, the output of the sensor 110 gives the displacement of the guide 1104 relative to the web position before the idler roller 904. Hence, we can transform this to the case where the rewind roller 1102 is stationary with respect to the ground and the web edge before the idler roller 904 is moving (see FIG. 12) i.e., we can consider the output of the sensor as $y_0$. Until now, we have been denoting the lateral motion of the web edge with respect to a reference, such as the ground as $y_0$, but in this case $y_0$ is the relative displacement between the rewind roller 1102 and the web edge before the idler roller 904. Now let $y_L$ denote the relative lateral motion of the web edge on the rewind roller 1102 with respect to the rewind roller 1102. The schematic for rewind guiding is as given in FIG. 13.

When force is applied on the rewind roller 1102 to displace it laterally in one direction, this causes a relative displacement of the web edge before the idler roller 904 in the opposite direction. In other words, if $\dot{z}_L(t)$ is the velocity of the rewind guide 1100 with respect to ground, then $y_0(t)=\dot{z}_L(t)$.

The total force acting on the rewind guide 1100 can be given by, $$F = \frac{d}{dt}(m\dot{z}_L) + b\dot{z}_L \tag{33}$$

where F is the force acting on the rewind guide setup, m is the mass of the whole rewind guide setup, which is moving, b is the friction coefficient, and $\dot{z}_L$ is the velocity of the rewind guide setup. As $\dot{y}_0(t)=\dot{z}_L(t)$, we can write the above equation as $$F = -\frac{d}{dt}(m\dot{y}_0) - b\dot{y}_0 \tag{34}$$

Using a similar argument as that given for the unwind roller case, we have $$Y_0(s) = \frac{-1}{ms^2 + b_1 s}F(s) = G_r(s)F(s) \tag{35}$$

where $b_1=(b+\rho b_w t_w v_0)$, $b_w$ is the web width, $\rho$ is the density of the web material, $v_0$ is the longitudinal velocity, $t_w$ is the web thickness, and m can be estimated at each sampling time using $$\frac{dm}{dt} = \rho b_w t_w v_0 \tag{36}$$

Now, the web dynamics for the span between the idler roller 904 and the rewind roller 1102 can be given using equation (12), with $\theta_L=\theta_0=Z_L=Z_0=0$. Again, this is because we can consider this as the case where the rewind roller 102 is stationary with respect to the ground and the web edge before the idler roller 904 is moving.

$$Y_L(s) = \left(\frac{-\frac{f_3(KL)}{\tau}s + \frac{f_1(KL)}{\tau^2}}{s^2 + \frac{f_2(KL)}{\tau}s + \frac{f_1(KL)}{\tau^2}}\right)Y_0(s) = G_w(s)Y_0(s) \tag{37}$$

Figure 13:
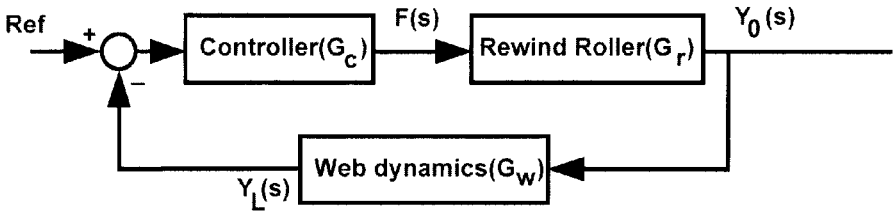
FIG. 13 is a schematic of the control loop of a rewind guide setup.

Thus, in FIG. 13, we have $G_r$ as given by equation (35) and $G_w$ as given by equation (37).

Lateral Control with Remotely Pivoted Guide (Steering Guide)

The lateral behavior of the web 108 while the web 108 is transported over the rollers is dependent on various physical parameters such as web tension, web material type, web geometry, and type of the web guide. The web lateral position with the remotely pivoted guide 400 can be modeled by the following transfer function $$Y_L(s) = \frac{s^2 + \beta_2 s + \beta_1}{s^2 + \beta_2 s + \beta_0}Z(s) \tag{38}$$

where $Y_L(s)$ is the Laplace transform of the web lateral position and Z(s) is the input to the guide 400 in the lateral direction. The coefficients $\beta_0$, $\beta_1$ and $\beta_2$ depend on the physical parameters such as the length of the entering web span, transport velocity, web tension, modulus of the web material, web geometry, etc, as described previously. Some of these parameters may vary with the process and some may not be known precisely. A controller that is designed based on nominal plant parameters (the coefficients $\beta_0$, $\beta_1$ and $\beta_2$) may not work efficiently when the actual plant parameters are different from the nominal plant parameters. Hence, a controller that adapts to changes in the plant parameters is desired. A controller called the guide adaptive controller that can adapt to the changes in the physical web process parameters is presented in the following section.

Guide Adaptive Controller

Figure 14:
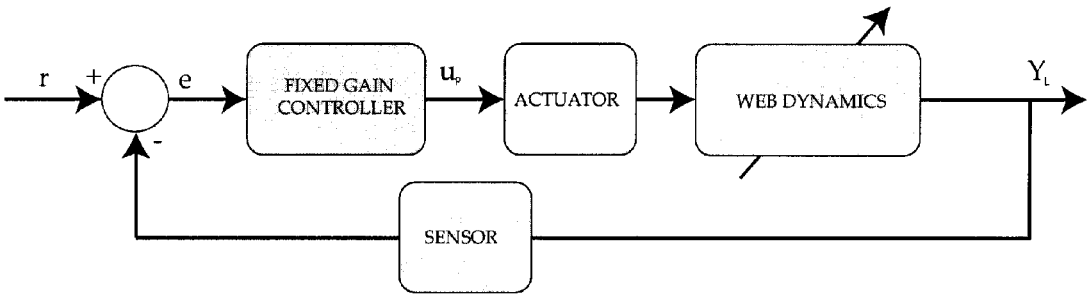
FIG. 14 is a schematic of the control loop of a lateral web guide control system.
Figure 15:
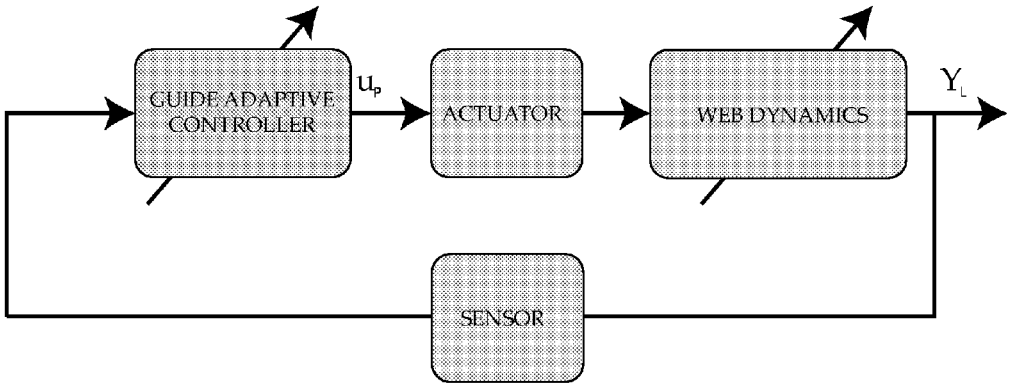
FIG. 15 is a schematic of a guide adaptive control system.
Figure 16:
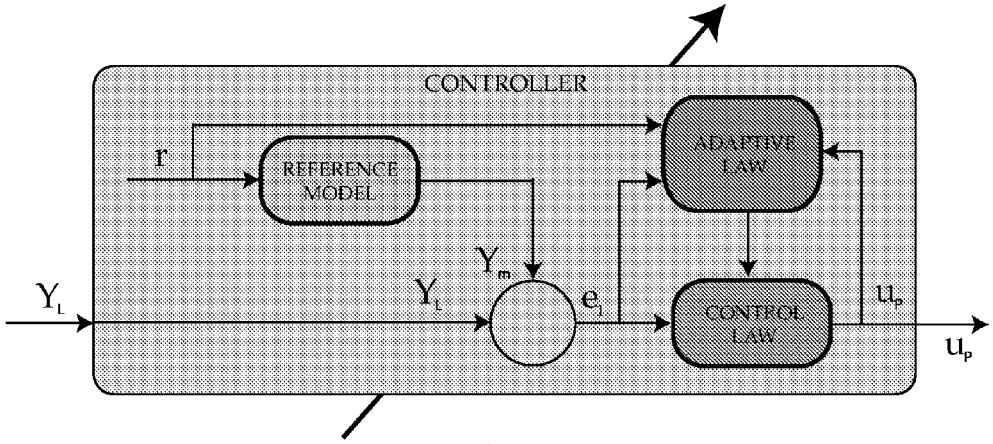
FIG. 16 is a schematic of a guide adaptive controller.

One industrial controller for web guiding is in the form shown in FIG. 14. The feedback control system consists of the sensor 110 which measures the actual position ($Y_L$) of the web and a controller which generates the control signal ($U_p$) to the actuator based on the desired (r) and actual position ($Y_L$) of the web. Typical industrial controllers are proportional (P), proportional-integral (PI) or proportional-integral-derivative (PID) controllers, which are designed based on nominal process parameters. The PI controller is predominantly used for controlling web guides. Since the dynamics of the web change with change in process parameters, a controller that is capable of adapting to the change is desired. A schematic of the presently disclosed guide adaptive controller is shown in FIG. 15. FIG. 16 shows a detailed schematic of the guide adaptive controller (GAC) block of FIG. 15.

One objective of the GAC is to ensure that the lateral web position $Y_L$, maintains the given desired position r. The GAC is designed so that the response of the closed-loop system matches the response of a desired reference model. Therefore, whenever the plant parameters vary the controller parameters of the GAC adapt to ensure that the actual web position is same as the desired web position. The GAC parameters are adapted based on observation of web position $Y_L$, measured by a sensor, the desired web position r and output of the reference model $Y_M$. The variable $Y_M$ is generated within the GAC block as an output of the given reference model whose input is r.

The mathematical model of the web dynamics along with the web guide dynamics (electro-mechanical actuator+transmission system) is given by $$\frac{Y_L(s)}{u_p(s)} = \frac{k_m C_m(s^2 + \beta_2 s + \beta_1)}{s(s+a)(s^2 + \beta_2 s + \beta_0)} \tag{39}$$

where $K_m$ and a are motor parameters and $C_m$ is the transmission ratio between the motor angle and the guide position. Another feature of the GAC controller is that it does not assume that the actuator parameters are known.

GAC Design

A second-order reference model of the form $$\frac{Y_M(s)}{r(s)} = \frac{\omega_n^2}{s^2 + 2\zeta\omega_n s + \omega_n^2} \tag{40}$$

is chosen. The choice of the reference model parameters ($\zeta$ and $\omega_n$) is based on common performance characteristics such as the settling time and percentage overshoot. Typically, a well damped reference model is chosen.

The control law for the GAC is given by $$u_p = \sum_{i=1}^{8} \theta_i \omega_i + \dot{\theta}_i \phi_i. \tag{41}$$

The adaptive law used to estimate the controller parameters is given by $$\dot{\theta}_i = -e_1 \gamma_i \phi_i \tag{42}$$

where $e_1 = Y_L - Y_M$, $\gamma_i > 0$ are adaptation gains and $\phi_i$ is a filtered version of a function $w_i$:

$$\phi_i = \frac{1}{(s + p_0)} \omega_i. \tag{43}$$

The functions $\omega_i$ are given by $$[\omega_1(s)\omega_2(s)\omega_3(s)] = \lfloor s^2 s 1 \rfloor u_p(s) G_{fil}(s) \tag{44}$$

$$[\omega_4(s)\omega_5(s)\omega_6(s)] = [s^2 s 1] Y_L(s) G_{fil}(s)$$

$$[\omega_7(s)\omega_8(s)] = [Y_L(s) r(s)]$$

where $$G_{fil}(s) = \frac{1}{(s + a_0)^3}.$$

The design parameter $a_0$ is chosen so that the bandwidth of the filter $G_{fil}(s)$ is more than the bandwidth of the actuator and less than the sensor noise bandwidth. The parameter $p_0$ is chosen based on the condition that $0 < p_0 < 2\zeta\omega_n$. Large values of $p_0$ will reduce the adaptation rate and small values of $p_0$ will result in faster adaptation. If $p_0$ is very small, then the adaptation may be sensitive to disturbances. So, there is a trade-off between the rate of adaptation and sensitivity of the estimated controller parameters to disturbances.

The adaptation gains $\gamma_i$ are all chosen as same values initially. As the adaptation gain in increased rate of adaptation is increased and vice-versa. Large adaptation gains result in rapid changes in the controller parameters and hence may lead to un-desirable transient performance while small adaptation gains may lead to inadequate performance. A proper set of adaptation gain values can be determined based on set point regulation experiments. The first six controller parameters $\theta_1$–$\theta_6$ may have large adaptation gains compared to the last two i.e., $\theta_7$–$\theta_8$ since the filter $G_{fil}(s)$ allows for higher gain values.

The adaptation will continue as long as the error $e_1$ is non-zero. To increase the robustness of the GAC a bound for the controller parameters $\theta_i$ may be set based on observation of the evolution of the controller parameters. A bounding algorithm which would limit the controller parameters to stay within a lower and an upper bound may be employed.

In a preferred embodiment the GAC assumes no initial knowledge of the controller parameters i.e., all the estimated controller parameters $\theta_i$ are initially assumed to be zero.

Freezing of Estimated Controller Parameters

The estimated controller parameters reach a steady-state value after some time. How fast the controller parameters reach the steady-state value depends on the adaptation gains. Once the steady-state value is reached in a preferred embodiment there is no significant change in the controller parameters. Therefore, adaptation can be stopped or the estimated controller parameters can be frozen. When the controller parameters are frozen, the controller behaves like a fixed gain controller with optimum value of gains for that operating condition.

When changes in the process parameters occur, adaptation can be resumed. This can be implemented by continuously monitoring the error between the actual and desired web position. Once the error exceeds a predefined limit the adaptation of the parameters can be resumed.

The decision on when to stop the adaptation can be made based on the adaptive law. Recall the adaptive law is given in equation (5). When the controller parameters reach a steady-state value $\theta_i$'s would be zero. Whenever all $\theta_i$'s are close to zero, then the adaptation can be stopped. In order to avoid the hypothetical conditions when steady state error is observed after the controller parameters reach a steady-state value, two conditions need to be met before stopping the adaptation. First, the error has to be below a predefined limit (small value) and second all the controller parameters should reach steady-state values.

Parameter Resetting

The GAC can be designed in such a way that the initial controller parameter estimates is not necessary. The GAC can be initialized with all the controller parameters as zero. This provides an added benefit of starting the adaptation at any time during the operation of a guide. If any of the estimated controller parameters exceed a chosen bound, then all the estimated controller parameters can be reset to zero. This resetting strategy does not affect the overall performance of the GAC.

GAC Process

Figure 17:
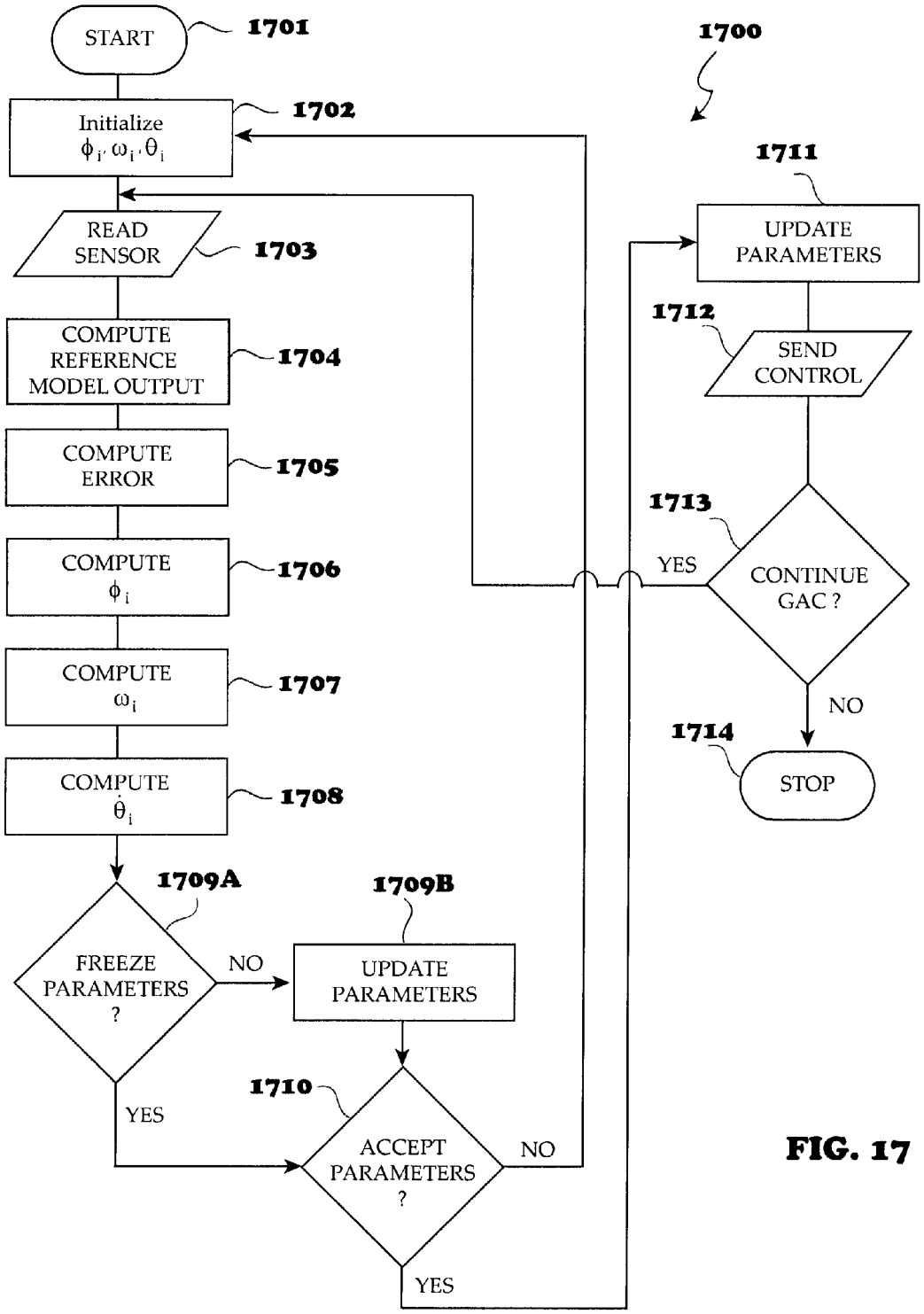
FIG. 17 is a flow diagram illustrating one possible control sequence of an adaptive web guide.

Referring now to FIG. 17, a flow diagram 1700 illustrating one possible control sequence of an adaptive web guide. The steps may be described as follows:

1701. Start

1702. Initialize $\phi_i = 0$, $\omega_i = 0$ and $\theta_i = 0$ for i=1 to 8.

1703. Read sensor: The sensor reading provides the measurement for the actual position of the web.

1704. Compute the reference model output $Y_M$: Given the desired web lateral position r compute the output of the reference model based on the mathematical model given in equation (3).

1705. Compute error: Calculate the difference between the reference model output $Y_M$ and the sensor measurement $Y_L$, i.e., $e_1 = Y_L - Y_M$.

1706. Compute $\omega_i$: The function $\omega_i$ is a filtered version of the measurement $Y_L$, control input $U_p$, and the desired web position r. Calculate $\omega_i$ based on equation (7).

1707. Compute $\phi_i$: $\phi_i$ is the filtered output of $\omega_i$ as per equation (6).

1708. Compute $\dot{\theta}_i$. Compute the rate of change of the controller parameters based on the adaptive law given in equation (5).

1709A-B. Parameter Freezing Check:

Check if the absolute value of error $e_1$ is less than a small positive constant. This small positive constant is chosen based on the required lateral position regulation accuracy.

Check if $\dot{\theta}_i$ are close to zero.

If both conditions are true (1709A), then do not update the controller parameters. If one of the above two conditions is false, update the controller parameters at 1709B by integrating $\theta_i$ obtained in 1708.

1710. Resetting Check: Check if the updated controller parameters are within their corresponding bounds. If any one of the controller parameters is outside the bound, reset all the controller parameters to zero. If all the parameters are within their corresponding bounds accept the controller update made in 1709B.

1711. Compute Control: Compute the control effort based on equation (4). Check if the computed control is within the actuator limits. If not, bound the control based on the actuator limits.

1712. Send the computed control to the guide actuator.

1713. Check to see if GAC has to be continued. If yes, go to step 3 else go to step 14.

1714. Stop.

Uniform Guide Adaptive Controller

The GAC disclosure presented thus far was developed based on the mathematical model for the remotely pivoted guide given in equation (2). None of the parameters in that model are assumed to be known but the GAC is capable of adapting to the unknown parameters. The mathematical model for the offset-pivot guide (displacement guide) is given by $$\frac{Y_L(s)}{Z(s)} = \frac{[-\beta_3 s + \beta_0][s^2 + \beta_2' s]\frac{L_1 - L}{L_1}}{[s^2 + \beta_2' s + \beta_0'][s^2 + \beta_2 s + \beta_0]} + \frac{s^2 + \beta_2 s + \beta_1'}{s^2 + \beta_2 s + \beta_0} \tag{4}$$

where the model parameters, β's, are not known. A GAC similar to the remotely pivoted guide can be developed for the offset-pivot guide as well. The difference between the two GAC's would be the number of estimated controller parameters.

In a commercially developed offset-pivot guide, the distance from the guide roller to the pivot axis, $L_1$, is very close to the span length of the guide. Therefore, taking $L_1$=L, the model given in equation (8) reduces to $$\frac{Y_L(s)}{Z(s)} = \frac{s^2 + \beta_2 s + \beta_1'}{s^2 + \beta_2 s + \beta_0} \tag{46}$$

Notice that the structure of this model is the same as that of the remotely pivoted guide; only the model parameters are different. Since knowledge of the model parameters is not required to implement the GAC developed earlier, the same GAC can be used for the offset-pivot guide. Therefore, a uniform controller can be used for both the remotely pivoted guide and offset-pivot guide.

Simplified Guide Adaptive Controller

The mathematical model can be approximated as $$Y_L(s) = \frac{k_m C_m \beta_1}{s(s+a)\beta_0} = \frac{K}{s(s+a)} \tag{47}$$

The GAC for the simplified model has four controller parameters (i=1, . . . , 4) and the parameters are updated based on the same adaptive law given by equation (5). The control update is calculated based on the same control law given in equation (4) and the $\phi_i$'s are computed based on equation (6). The function $\omega_i$ is given by $$[\omega_1(s), \omega_2(s), \omega_3(s), \omega_4(s)] = \left[\frac{1}{s+a_0}u_p, \frac{1}{s+a_0}Y_L, Y_L, r\right] \tag{48}$$

Selection of the design parameters is similar to the design presented previously. The simplified GAC can be implemented for both the guides. The GAC based on simplified mathematical model reduces the number of floating point operations performed in each sampling period.

It should be understood that the processes described above can be performed by the controller using suitable hardware, such as a processor accessing and executing computer executable instructions adapted to perform the functions described above. Such computer executable instructions embodying the logic of the processes described herein, as well as the resulting data are stored on one or more computer readable mediums accessible by the hardware of the controller. Examples of a computer readable medium include an optical storage device, a magnetic storage device, an electronic storage device or the like. The term "processor" as used herein means a system or systems that are able to embody and/or execute the logic of the processes described herein. The logic embodied in the form of software instructions or firmware may be executed on any appropriate hardware which may be a dedicated system or systems, or a general purpose computer system, or distributed processing computer system, all of which are well understood in the art, and a detailed description of how to make or use such computers is not deemed necessary herein. When the computer system is used to execute the logic of the processes described herein, such computer(s) and/or execution can be conducted at a same geographic location or multiple different geographic locations. Furthermore, the execution of the logic can be conducted continuously or at multiple discrete times. Further, such logic is preferably performed about simultaneously with the receipt of data so that the controller guides the web 108 in real-time. However, some of the steps of the processes can prior to or after the guiding of the web 108, such as the step of initializing the controller with the controller parameters.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A method of adaptive guiding of a web on a roller, comprising:

measuring a position of the web;

calculating the difference $e_1$ between an output of a model equation and the measured position;

computing a value for a first parameter (w) belonging to a set of parameters of the model equation initialized to zero, the first parameter being a function of measured position of the web, a control input value on the roller, and a desired web position;

computing a value for a second parameter ($\phi$) belonging to the set of parameters of the model equation, the second parameter being a filtered output of the first parameter;

computing a value for a third parameter ($\dot{\theta}$) belonging to the set of parameters of the model equation, the third parameter being a rate of change of $e_t$ and the second parameter;

when at least one of $e_1$ is greater than a predetermined constant and the third parameter is greater than a predetermined difference from zero, computing the control parameters by integrating the third parameter;

when the updated control parameters are outside a set of predetermined bounds, resetting the controller parameters to zero;

when the updated control parameters are within the set of predetermined bounds, computing a new control input based on the updated controller parameters; and when the new control input is within limits of a guide actuator, providing the new control input to the guide actuator.

2. The method of claim 1, further comprising freezing the parameters when the computed values for the control parameters are changed less than a predetermined amount from the previous values.

3. The method of claim 1, wherein only one guide roller is controlled.

4. The method of claim 1, wherein a plurality of guide rollers are controlled.

* * * * *